US006439860B1

(12) United States Patent
Greer

(10) Patent No.: US 6,439,860 B1
(45) Date of Patent: Aug. 27, 2002

(54) CHAMBERED VANE IMPELLER MOLTEN METAL PUMP

(76) Inventor: Karl Greer, 1150 Yelvington-Knottsville Rd., Maceo, KY (US) 42355

( * ) Notice: Subject to any disclaimer, the term of this patent is extended or adjusted under 35 U.S.C. 154(b) by 25 days.

(21) Appl. No.: 09/716,658

(22) Filed: Nov. 20, 2000

Related U.S. Application Data

(60) Provisional application No. 60/166,918, filed on Nov. 22, 1999.

(51) Int. Cl.[7] ..... F04B 17/00; F04B 35/00

(52) U.S. Cl. ..... 417/360; 417/423.15; 417/424.1; 415/200

(58) Field of Search ..... 415/200, 216.1; 417/423.3, 423.15, 360, 423.1, 424.1

(56) References Cited

U.S. PATENT DOCUMENTS 5,203,681 A * 4/1993 Cooper ..... 417/424.1
5,332,373 A * 7/1994 Schendel ..... 417/360
5,558,505 A * 9/1996 Mordue et al.
5,586,863 A * 12/1996 Gilbert et al. ..... 415/200
5,634,770 A * 6/1997 Gilbert et al. ..... 415/216.1
5,685,701 A * 11/1997 Chandler et al. ..... 417/424.1
5,842,832 A * 12/1998 Thut ..... 417/53
5,944,496 A * 8/1999 Cooper ..... 417/360
5,951,243 A * 9/1999 Cooper ..... 415/110
6,093,000 A * 7/2000 Cooper ..... 417/423.6
6,250,881 B1 * 6/2001 Mordue et al. ..... 415/200

* cited by examiner

*Primary Examiner*—Charles G. Freay
*Assistant Examiner*—Han Lieh Liu
(74) *Attorney, Agent, or Firm*—George H. Morgan; Mark A. Manley

(57) ABSTRACT

The invention is a chambered vane impeller molten metal pump comprising a drive means, a motor mount, a coupling with a taper facilitating shaft removal, a shaft with a tapered top and a bottom with dovetail mating grooves for accepting impeller vanes, a bearing supporting the shaft, tapered support sockets, supports comprising a tapered end, an aperture, and groove, a laminated base, and a fabricated chambered vane impeller. The drive can be a motor with a gear box where the motor is air, hydraulic, electric, or a prior art direct drive electric motor with a soft start.

13 Claims, 12 Drawing Sheets

2
2A
1
4
9
9
9A
10
11
9
9A
10
11
11
INTAKE FLOW
INTAKE FLOW
26
OUTLET FLOW
13
30

CHAMBERED VANE IMPELLER MOLTEN METAL PUMP

CROSS REFERENCES TO RELATED APPLICATIONS

Provisional Application for Patent No. 60/166,918 of Nov. 22, 1999 of the same title, Chambered Vane Impeller Molten Metal Pump, which is hereby incorporated by reference in its entirety and for which Applicant claims priority pursuant to 35 U.S.C. Par. 119 (e)(i).

STATEMENT AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

This invention relates to molten metal pumps such as are used in, but not restricted to, aluminum facilities.

2. Background Information

Prior art molten metal pumps are described in patents including:

| | | |
|---|---|---|
| U.S. Pat. No. 5,203,681 | Cooper | Apr. 20, 1993 |
| U.S. Pat. No. 5,586,863 | Gilbert et al | Dec. 24, 1996 |
| U.S. Pat. No. 5,634,770 | Gilbert et al | June 3, 1997 |

Molten metal pumps are used for circulating, transfering, and gas injecting molten metal. It is a harsh environment so the pumps have relatively short lives and are expensive to repair. The pumps are difficult to disassemble. The supports are difficult to remove from bases as they typically are cemented in place.

Pumps with impellers of a nine inch or greater diameter currently use 25 horsepower, or larger, direct drive electric motors with expensive variable frequency drive units.

Motor mounts tend to warp after exposure to heat from the molten metal. Insulation used below the motor mounts tend to get torn off with normal production use. As a motor mount warps, pump alignment is affected and tends to cause a rotating shaft to lock up. Also, warping of the motor mount puts added stress on a pump base, and tends to cause the base to crack, which destoys the pump.

After existing pumps are in use, it is difficult to get a used shaft uncoupled from its pump.

Some existing pumps use a ceramic bearing below the surface of molten metal. The ceramic bearing is susceptable to thermal shock and prone to failure. Other existing pumps do not use a ceramic bearing, and there are problems with motor bearings and couplings.

There are problem areas in how supports are joined to pumps in that alignment is a problem. Also, cement is relied on, in some cases, which requires a drying times that, combined with painstaking procedures typically required a two day repair cycle.

Existing pump bases are typically a monolithic block that does not lend itself to repair.

Existing pump impellers have problems. Impellers with cup shapes tend to clog up. Exisitng vane impellers have edges that wear away rather rapidly, so efficiency is lost. If the pump speed is increased, to compensate for the loss in efficiency, dross is created by the higher speed. Existing vane and cup impellers are made out of a monolithic block and machined so they have to be threaded to a shaft, or cemented and pinned to a shaft. That means not all the vane area is utilized for pushing metal but is used to adhere to the shaft. The monolithic block construction results in internal cavity shapes that are not optimum from a performance standpoint due to geometric limitations of what can be accomplished by a machine tool in machining an impeller from a block.

Also, the pump impeller housings are machined from a block. This could be called a monolithic block construction. Carbon graphite is anisotropic in nature. This means it has different strengths in different directions. This is a limiting factor in the structural strength of prior art pump impeller housings.

As will be seen from the subsequent description, the preferred embodiments of the present invention overcome these and other shortcomings of exisitng liquid transport apparatuses.

SUMMARY OF THE INVENTION

The present invention is a chambered vane impeller molten metal pump comprising a drive means, a motor mount with improved gussets, a coupling with a taper for easy shaft removal, a shaft with a tapered top and a bottom with dovetail mating grooves for accepting impeller vanes, a journal bearing above or below a mount for the drive means, tapered Dost sockets, supports each with an end tapered and the other end grooved, support sheaths, a laminated base, a fabricated chambered vane impeller, and an outlet.

In the preferred embodiment of the present invention, the drive means is an electric motor and a gear box with a soft start package so as to control initial start up accelerations. An alternate embodiment is an air motor and gear box combination. Another alternate embodiment is a hydraulic drive motor.

BRIEF DESCRIPTION OF THE DRAWINGS

FIG. 3 is a view of the present invention with additional details.

DESCRIPTION OF THE PREFERRED EMBODIMENTS

Figure 1:
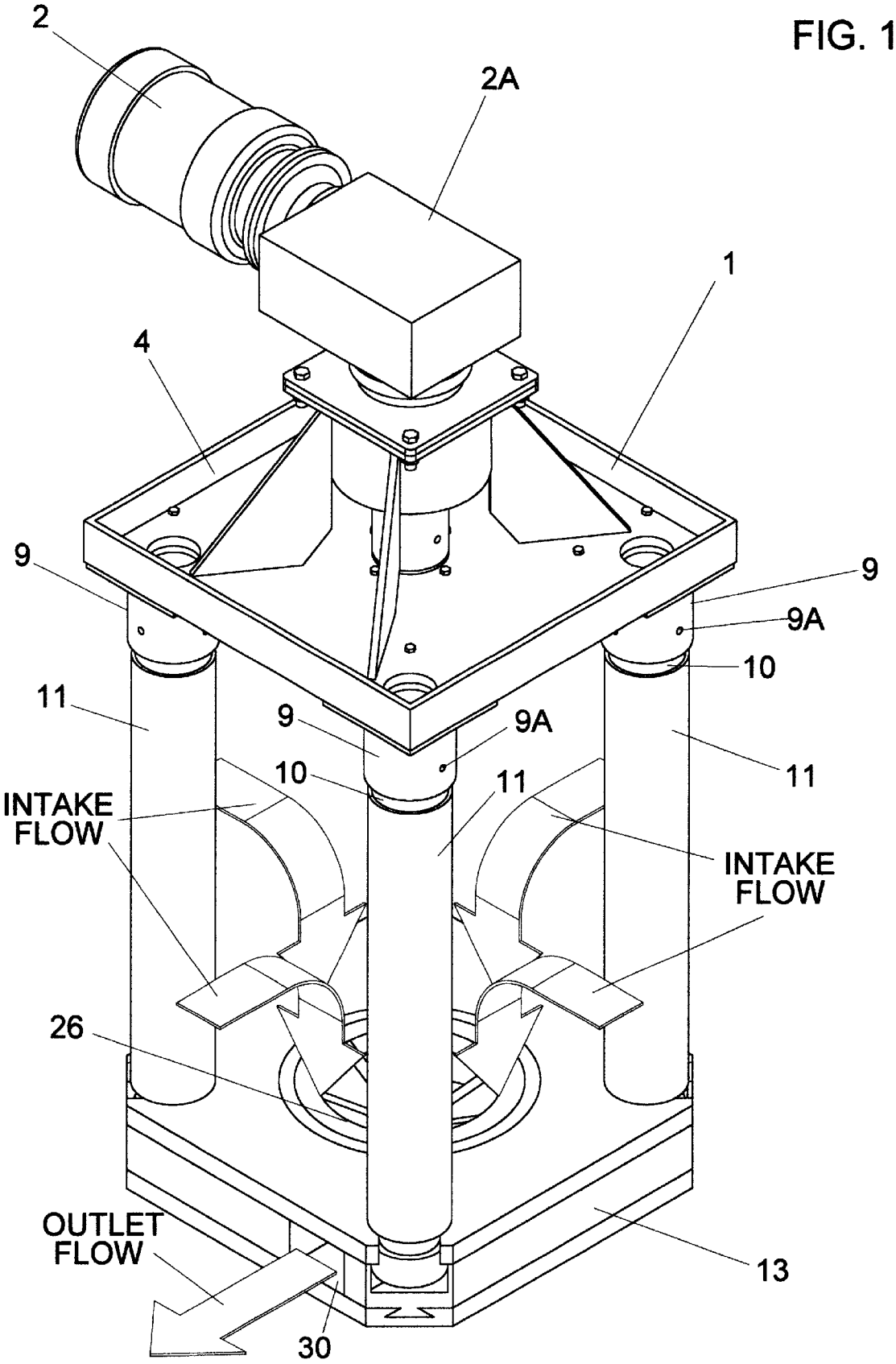
FIG. 1 is a view of the preferred embodiment of the present invention.
Figure 2:
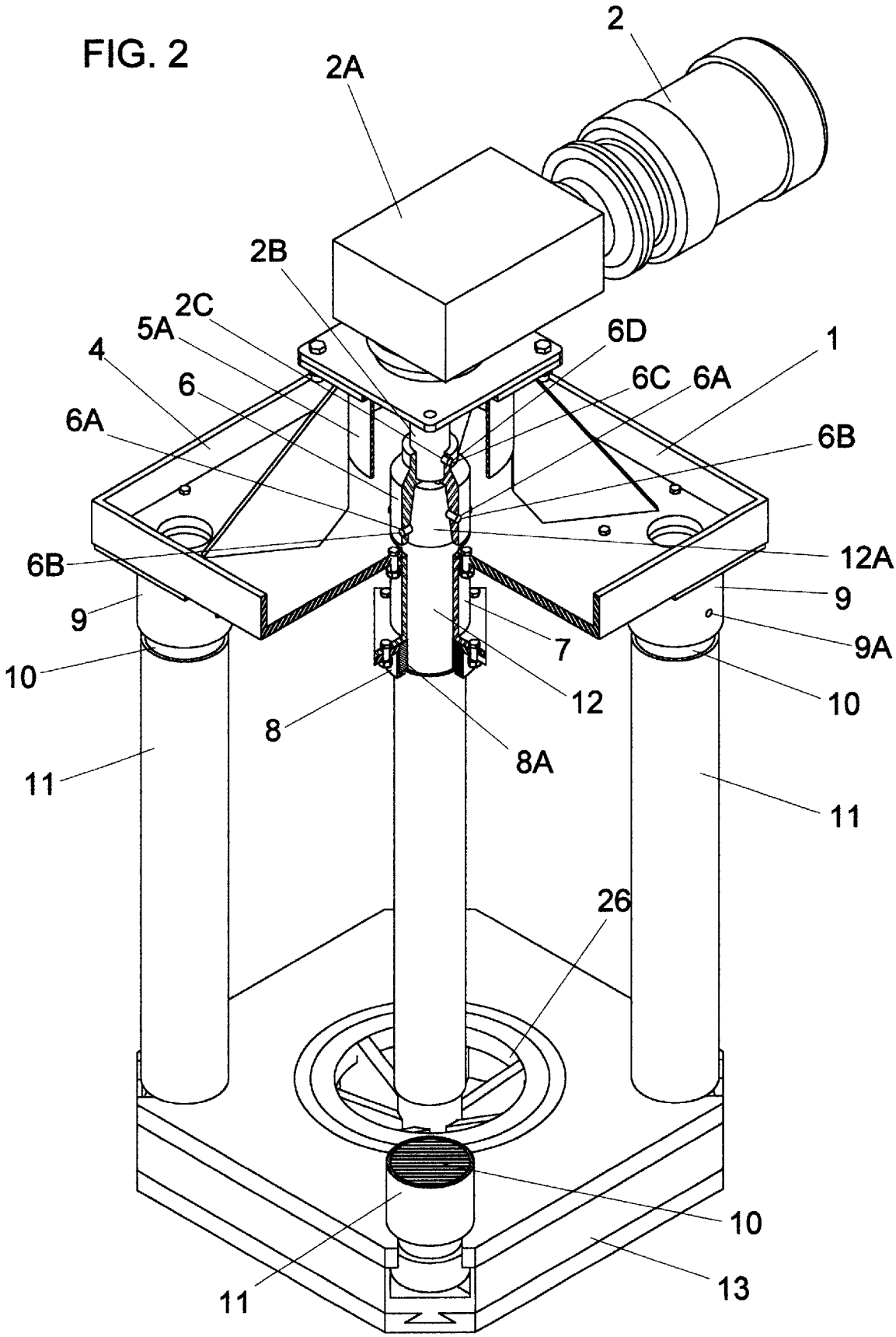
FIGS. 2 and 3 are views of the preferred embodiment illustrating additional details.
Figure 4:
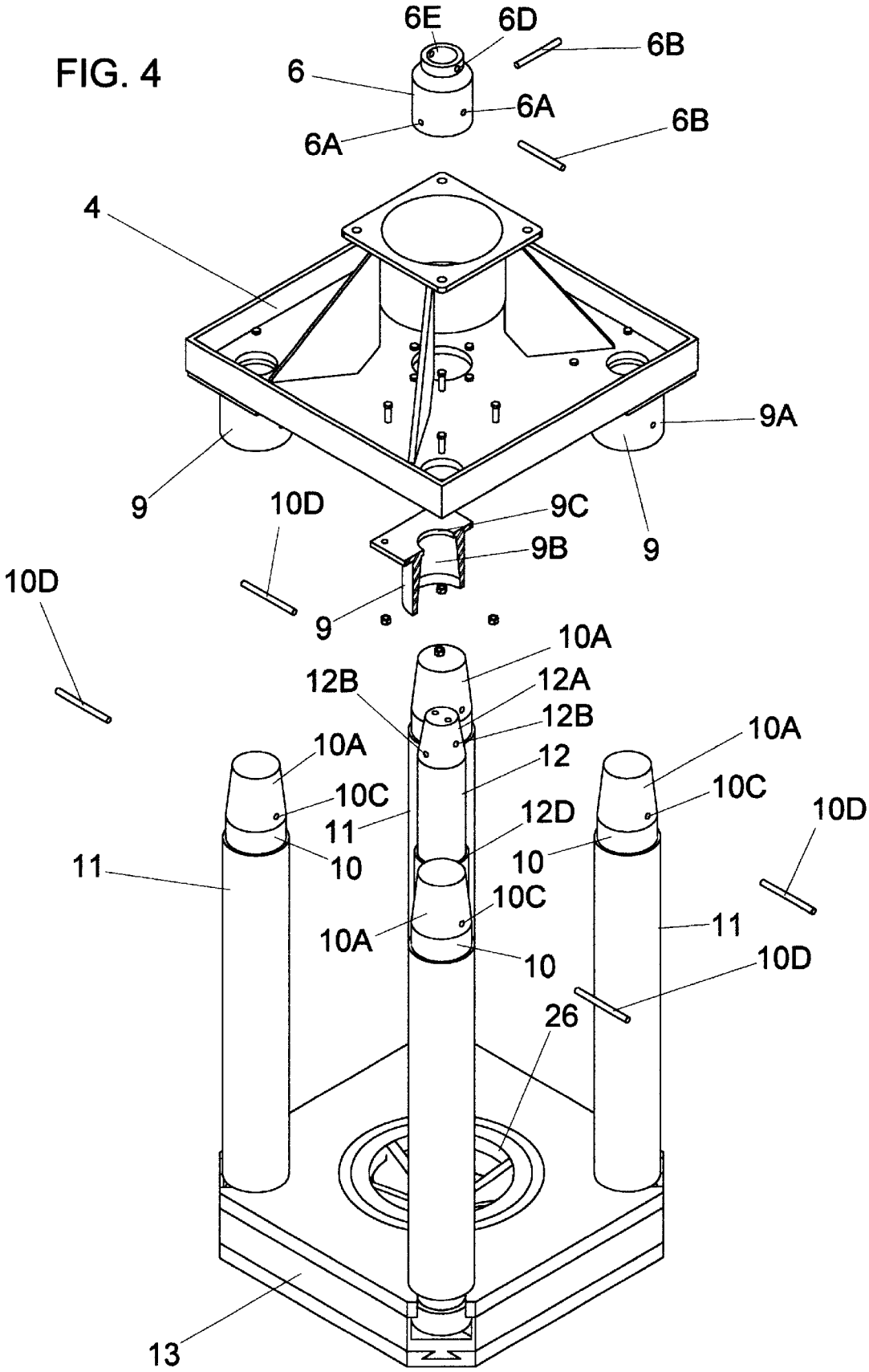
FIG. 4 is a partially exploded view of the present invention.
Figure 5:
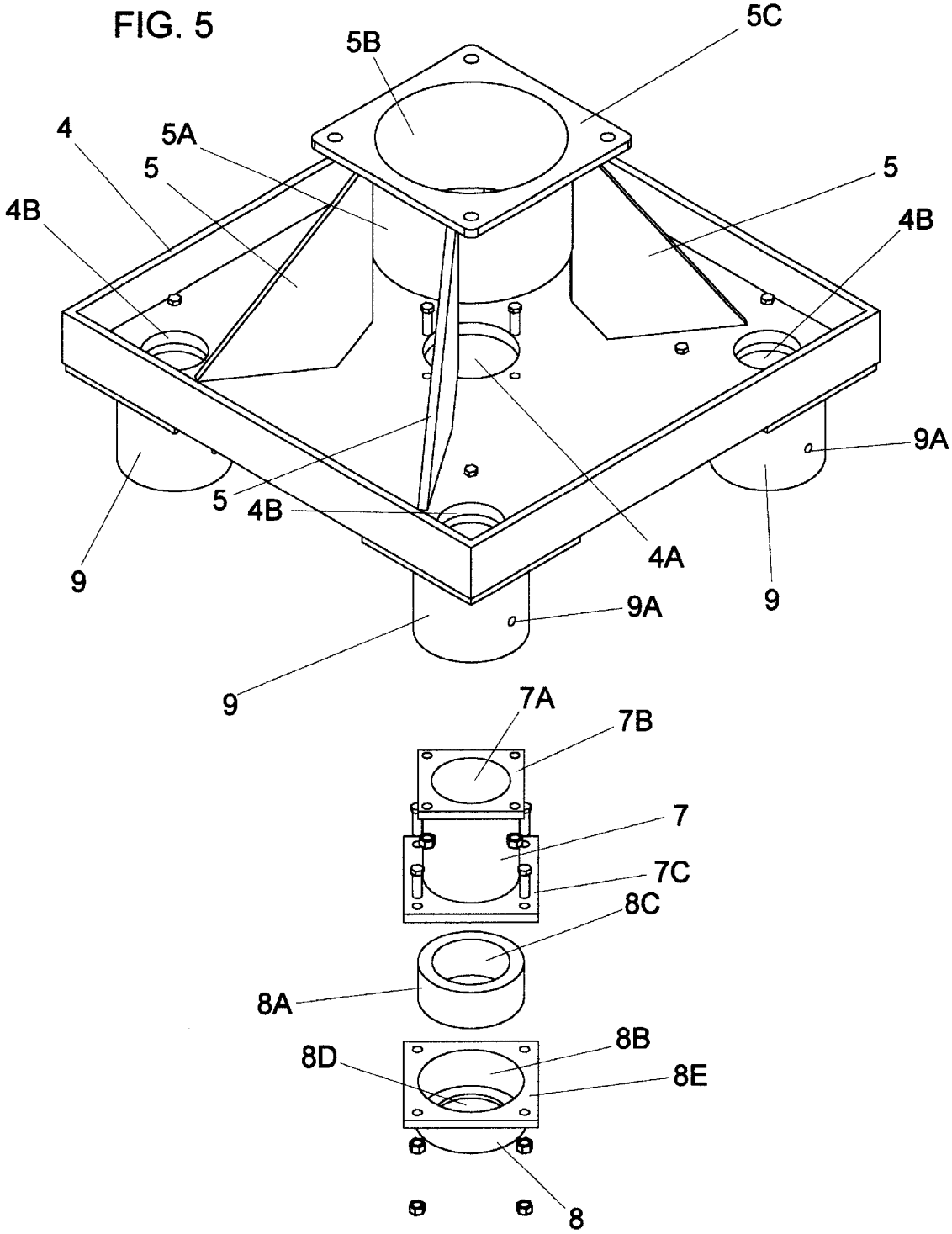
FIG. 5 illustrates shaft bearing details.

As shown in FIGS. 1, 2, and 4, the preferred embodiment of the present invention, a chambered vane impeller molten metal pump 1 comprises a motor 2, a reduction gear assembly 2A, a motor mount 4, a bearing mount extension 7, a bearing housing 8, a bearing 8A, a mount flange 8E, supports 10, sheaths 11, impeller drive shaft 12, pump housing 13, a chambered vane impeller 26, and in outlet 30.

FIG. 1 has arrows indicating direction of hot metal flow into and out of said pump 1. Molten metal flows into the chambered vane impeller 26, being pumped radially through said impeller 26, and out the outlet 30 as shown by the directional arrow labeled outlet flow.

Said gear assembly 2A comprises an output shaft 2B, said out put shaft comprising a lock pin clearance 2C.

As shown in FIGS. 2, 3, 4, and 5, the motor mount 4 comprises a pump drive shaft clearance 4, drift pin clearances 4B, stiffening gussets 5, a motor mount tube 5A further comprising a drive means mounting face 5C, tapered sockets 9, each of which tapered sockets mate with a locating taper 10A on one of said supports 10, each of which said sockets 9 comprise a clearance 9A for a locking pin 10D and a socket drift pin clearance 9B.

The motor mount tube 5A is affixed to the stiffening gussets 5 which are affixed in place as a part of the motor mount 4.

The tapered sockets 9 are attached to the motor mount 4.

The sheaths, 11 serve as heat shields protecting said supports 10. In the preferred embodiment of the present invention, the sheaths 11 are of ceramic, which is known to the hot metal pump trade.

The motor 2, in the preferred embodiment of the present invention is an electric motor combined with a soft start system, although an air motor or a hydraulic motor will serve the same purpose.

Referring to FIGS. 2, 3, 6, 7, 8 and 9, said pump 1 further comprises an internally tapered coupler 6 and locking pins 6B and 6C. Said coupler 6 further comprises locking pin clearances 6A and 6D, a shaft end clearance 6E for the output shaft 2, locating studs 6F that mate with stud clearances 12E of the impeller drive shaft 12, and a shaft end tapered clearance 6G for the tapered shaft end 12A.

The impeller drive shaft 12 comprises the tapered shaft end 12A that fits into said clearance 6D, shaft end locking pin clearances 12B, and dovetail mating grooves 12C that fit over dovetail inserts 24B of impeller vanes 24.

Said coupler 6 connects to output shaft 2B of said gear assembly 2A by means of the locking pin 6C through the lock pin clearance 2C of said gear assembly 2A and through the locking pin clearance 6D of the coupler 6.

The coupler 6 connects to the impeller shaft 12 by means of the locking pins 6B through the locking pin clearances 6A in the coupler 6 and the shaft end locking pin clearances 12B, and the mating of the locating studs 6F of the coupler 6 and the stud clearances 12E of the impeller drive shaft 12.

In the preferred embodiment of the present invention, the shaft 12 is carbon graphite, which is known in the trade of hot metal pumps.

Referring to FIGS. 2, 3, 5, and 9, the bearing mount extension 7 comprises a mount shaft clearance 7A for the shaft 12, a motor mount mounting flange 7B, and a bearing housing mounting flange 7C.

The bearing 8A comprises a shaft clearance 8C.

The mount flange 8E comprises a bushing locating bore 8B and a housing shaft exit opening 8D.

The motor mount mounting flange 7B connects to the motor mount 4 and also to the mount flange 8E.

The motor mount mounting flange 7B together with the bearing 8A, which is contained in the mount flange 8E, support the impeller drive shaft 12.

In the preferred embodiment of the present invention, the motor mount mounting flange 7B and the mount flange 8E are of steel and the bearing 8A is of carbon graphite, although, as obvious to anyone skilled in the art, other material combinations might serve the same purpose.

The motor mount 4 and the coupler 6 are steel, in the preferred embodiment of the present invention.

Referring to FIGS. 1, 2, 3, 4, and 6, each of the supports 10 comprise a tapered end 10A, locking 6 grooves 10B, each of which locking groove 10B mates with a fitted groove 13B, a support locking pin clearance 10A, a locking pin 10D, and lower locking bosses 10E each of which locking bosses 10E fits into a boss clearance 13A.

Figure 6:
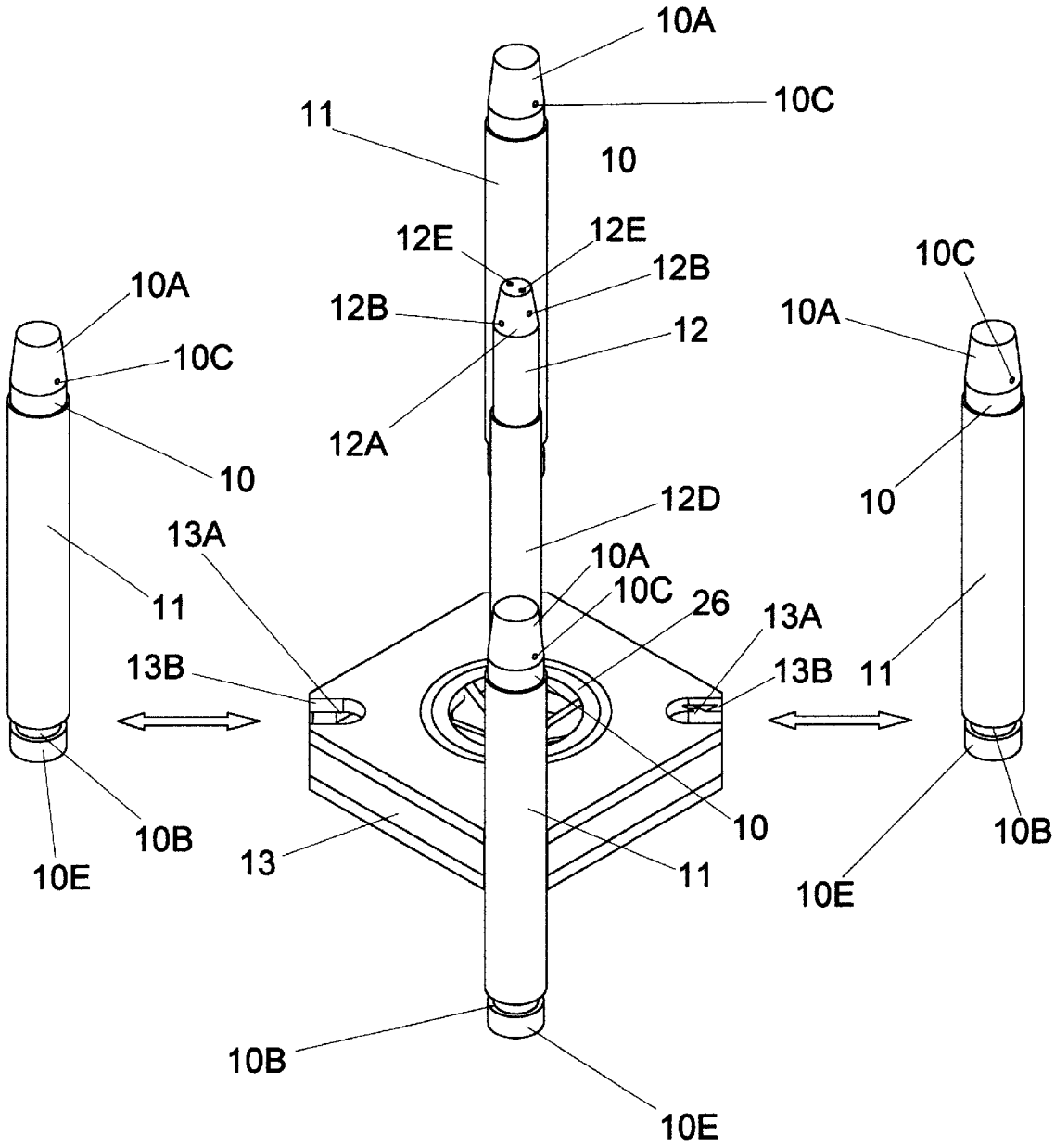
FIG. 6 illustrates a laminated base and support details.
Figure 7:
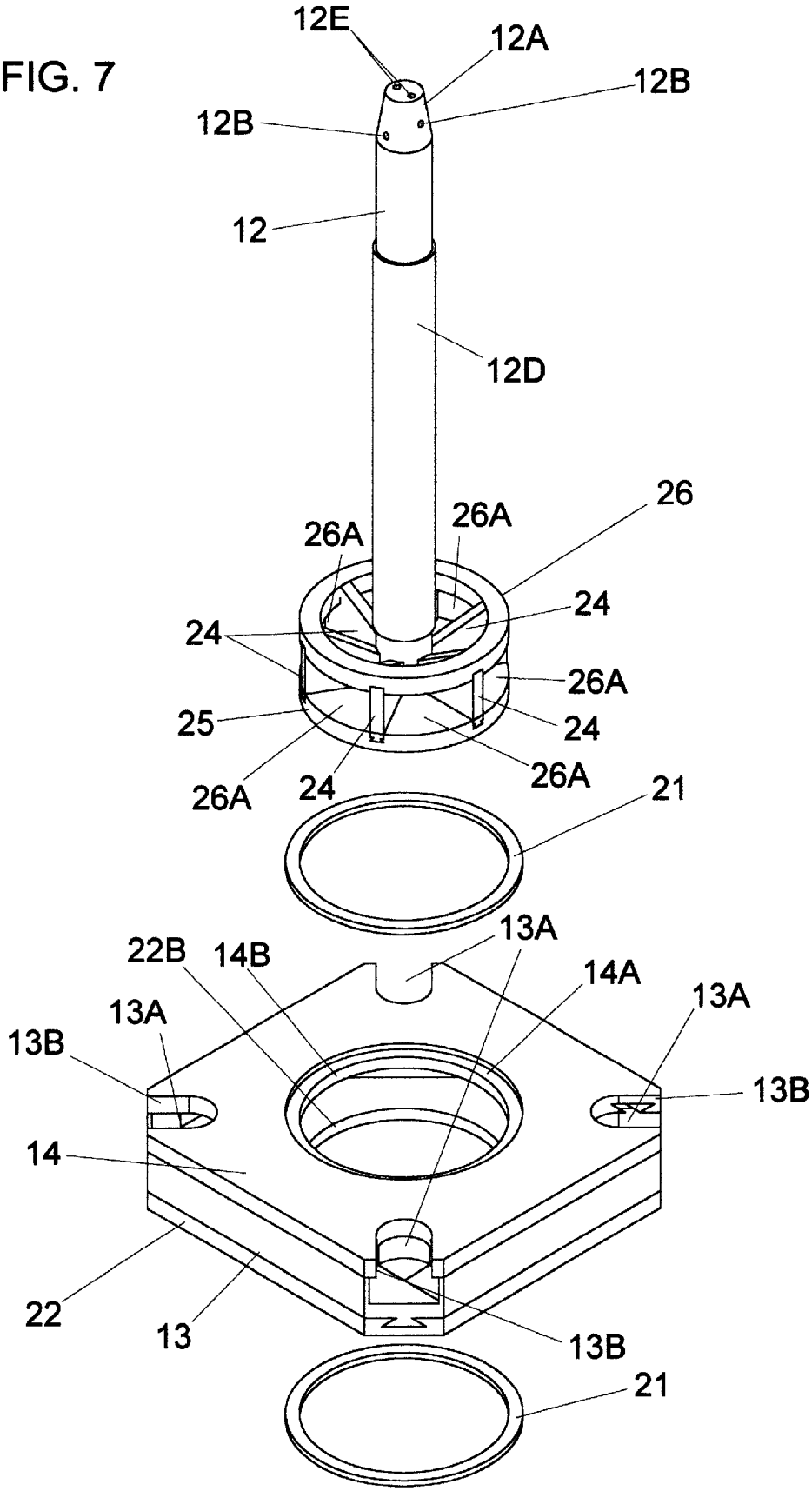
FIG. 7 illustrates the laminated base, a shaft and a chambered vane impeller.

Arrows in FIG. 6 indicate how said supports 10 insert laterally into the laminated base 13. Motor mount 4 will hold the supports 10 in a lateral position once said pump 1 is assembled. Not using cement to secure the supports 10 to the laminated base 13 facilitates disassembly of said pump 1 and is an improvement over prior art. Some lateral movement of the supports 10 with respect to the base 13 is permitted, which reduces said pump 1 misalignment problems as compared to having supports 10 cemented in place.

Referring to FIGS. 1, 2, 3, 6, 7, 10, and 11.

The laminated base 13 comprises boss clearances 13A, each of which boss clearances 13A mate with one of the locking bosses 10E; fitted grooves 13B, each of which fitted grooves 13B mate with one of the locking grooves 10B; a top plate 14; a sidewall one 15; interior corner inserts 16; a sidewall two 17; a sidewall three 18; a flow director 19; a sidewall four 20; bearing rings 21; a bottom plate 22; and an outlet 30.

The top plate 14 comprises a bearing ring counterbore 14A which accepts a bearing ring 21, an impeller clearance 14B, a locking groove 14D, and a shorter locking groove 14E.

The sidewall one 15 comprises a sidewall one upper dovetail locking insert 15A; a sidewall one lower dovetail locking insert 15B; and sidewall one cutaways 13C, each of said cutaways 13C forming a portion of one of the boss clearances 13A.

The sidewall four 20 comprises a sidewall four upper dovetail locking insert 20A; a sidewall four lower dovetail locking insert 20B; and sidewall cutaways 13C, each of said cutaways 13C forming a portion of one of the boss clearances 13A.

The sidewall four 20 is a mirror image of the sidewall one 15.

The sidewall two 17 comprises a sidewall two dovetail locking insert 17A; a bottom sidewall two dovetail locking insert 17B; and sidewall two cutaways 13F, each of said cutaways 13F forming a portion of one of the boss clearances 13A.

The sidewall three 18 comprises a sidewall three dovetail locking insert 18A; a bottom sidewall three dovetail locking insert 18B; and one of the abovesaid cutaways 13F forming a portion of one of the boss clearances 13A.

The bottom plate 22 comprises a bottom plate impeller clearance 22B and dovetail locking grooves 22C, 22D, 22E, and 22 F.

In the preferred embodiment of the present invention, with the exception of the bearing rings 21, which are silicon carbide, the laminated base 13 is of carbon graphite, held together by an appropriate cement such as is used in the trade, where required.

The laminated base 13, of carbon graphite, has a structural advantage over a one piece machined monolithic block construction base. Carbon graphite has a granular structure that is anisotropic. In physics, anisotropic is defined as having unequal strengths along different axes. This characteristic of carbon graphite is useful in constructing a laminated base 13 of carbon graphite that is stronger than a base of monolithic block construction. Thus, the laminated base 13 results in a stronger base than prior art monolithic block bases by taking this anisotropic characteristic of carbon grapite granular structure in consideration, with proper attention to the axes of greatest strength, during the manufacture and assembly into the laminated base 13 of said top plate 14, sidewalls 15, 17, 18, and 20; the bottom plate 22; the interior corner inserts 16; and the flow director 19.

Referring to FIGS. 3, 4, 6, 7, and 8:

The chambered vane impeller 26 comprises a locking ring 23 with locking slots 23A, impeller vanes 24, and an impeller bottom plate 25.

Each impeller vane 24 comprises a locking notch 24A; a vertical dovetail locking insert 24B which fits into the groove 12C of the shaft 12; and a horizontal dovetail locking insert 24C which fits into a groove 25B of the impeller bottom plate 25.

Each of the locking slots 23A of the locking ring 23 mate with a locking notch of one of the vanes 24. The vanes 24 slope downward from the locking ring 23.

The locking ring 23 protects the vanes 24 from wear. This is a difference, and an advantage, over prior art where vanes are not protected from wear by a wear ring.

In the preferred embodiment of the present invention, the locking ring 23 typically is made of silicon carbide. Said impeller 26 is assembled and attached to said shaft 12 by cement. As obvious to anyone skilled in the art, mechanical means of attachment are an alternative to cement. Said shaft 12 and said impeller 26 become an integral unit shipped with a new pump or sold as a replacement part, in the preferred embodiment.

The impeller bottom plate 25 comprises a bottom plate shaft clearance 25A and bottom plate dovetail locking grooves 25B.

The gap between the side 18 and the flow director 19 in the assembled laminated base 13 serves as the outlet through which molten metal is pumped. The corner blocks 16 and the flow director 19 provide for a cavity that avoids corners that would increase turbulence as well as cause metal build up. Reducing flow turbulence of the molten metal is highly desirable. This optimum shape is not obtainable with current bases machined from a solid block of carbon braphite.

When said pump 1 is immersed in hot metal, the chambered vane impeller 26, in the laminated base 13, pumps the hot metal through the laminated base 13 and out the outlet opening 30.

Figure 12:
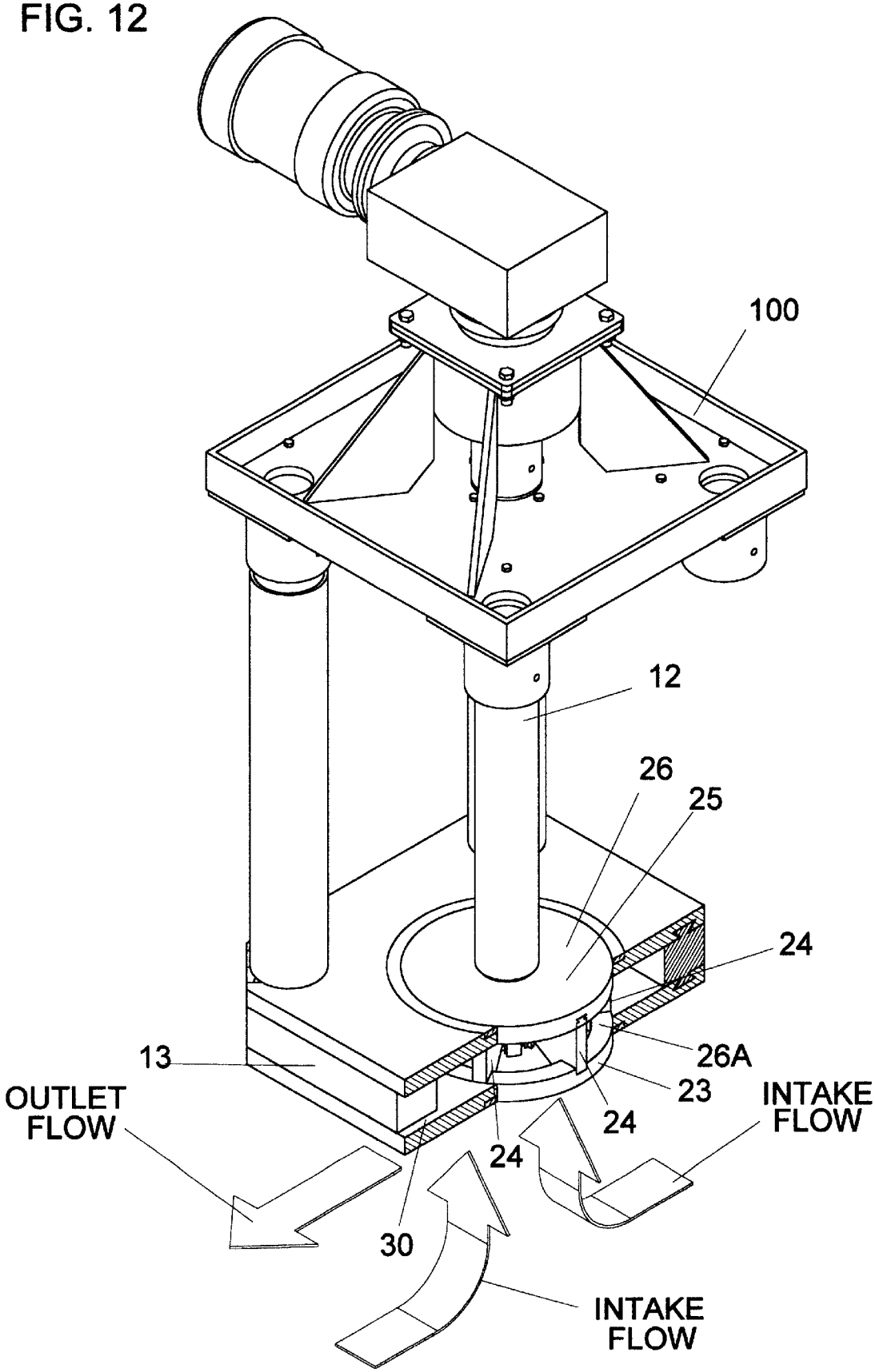
FIG. 12 illustrates an alternate embodiment of the invention.

FIG. 12 illustrates an alternate embodiment of the present invention, wherein the pump 100 as said impeller 26 installed upside down as compared to said pump 1 shown in FIG. 1. As shown in FIG. 12, molten metal flows up from below as shown by the directional arrows labeled intake flow, being pumped through said impeller 26 and out the outlet 30 as indicated by the directional arrow labeled outlet flow. Note in FIG. 12 the locking ring 23 and said plate 25 positions as compared to FIG. 8.

Figure 3:
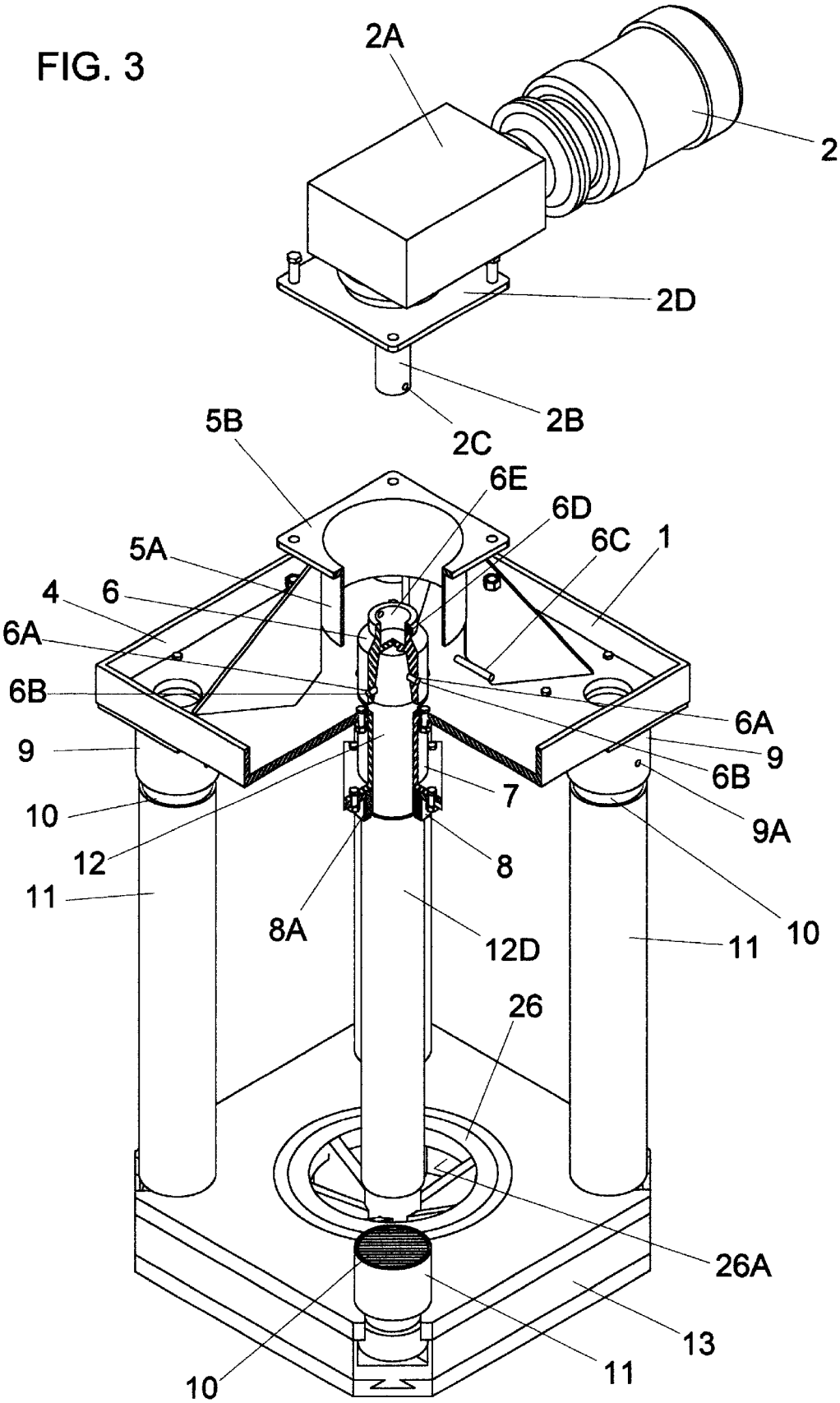
Figure 8:
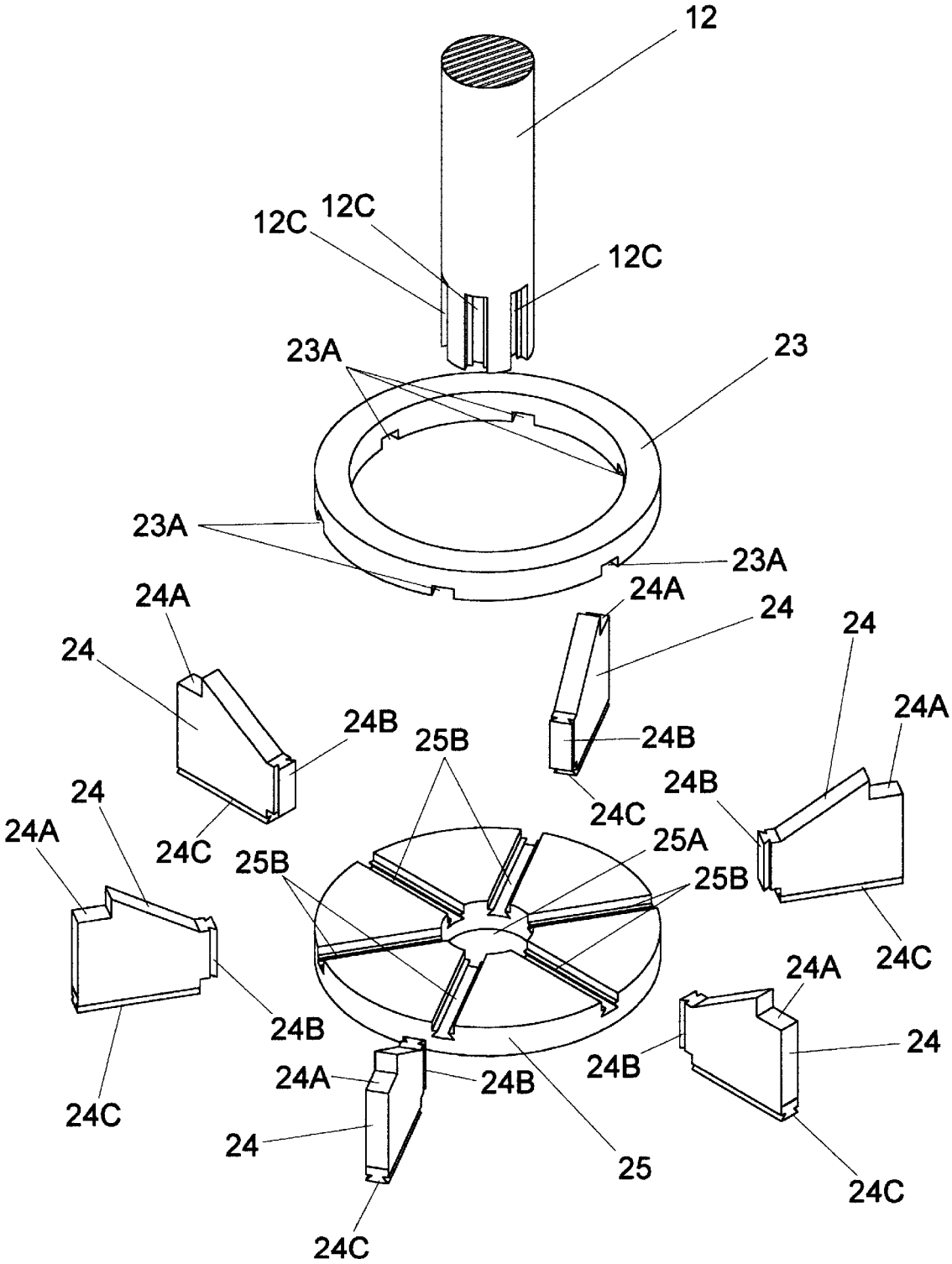
FIG. 8 illustrates impeller parts.
Figure 9:
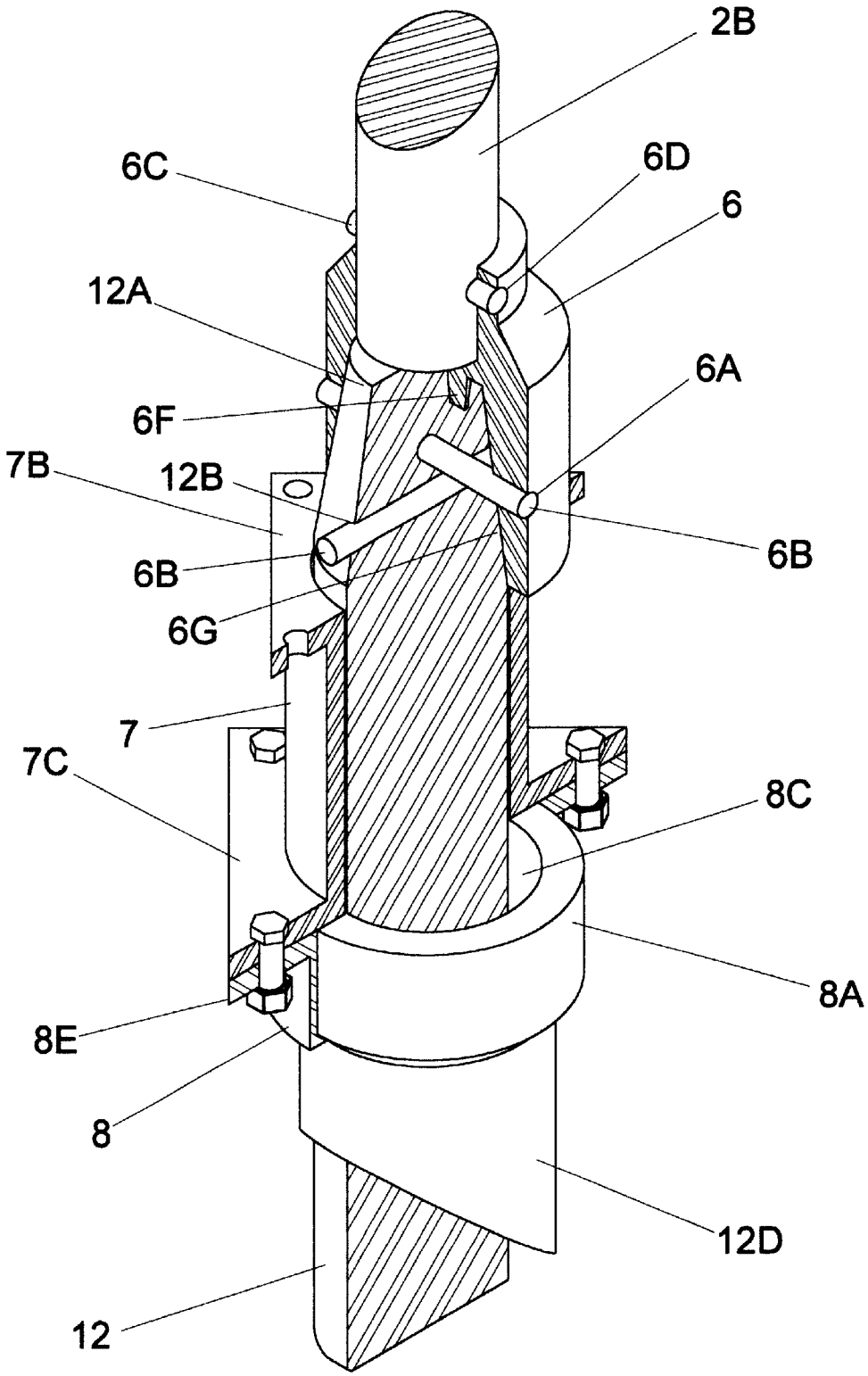
FIG. 9 illustrates the shaft and adjoining parts.
Figure 10:
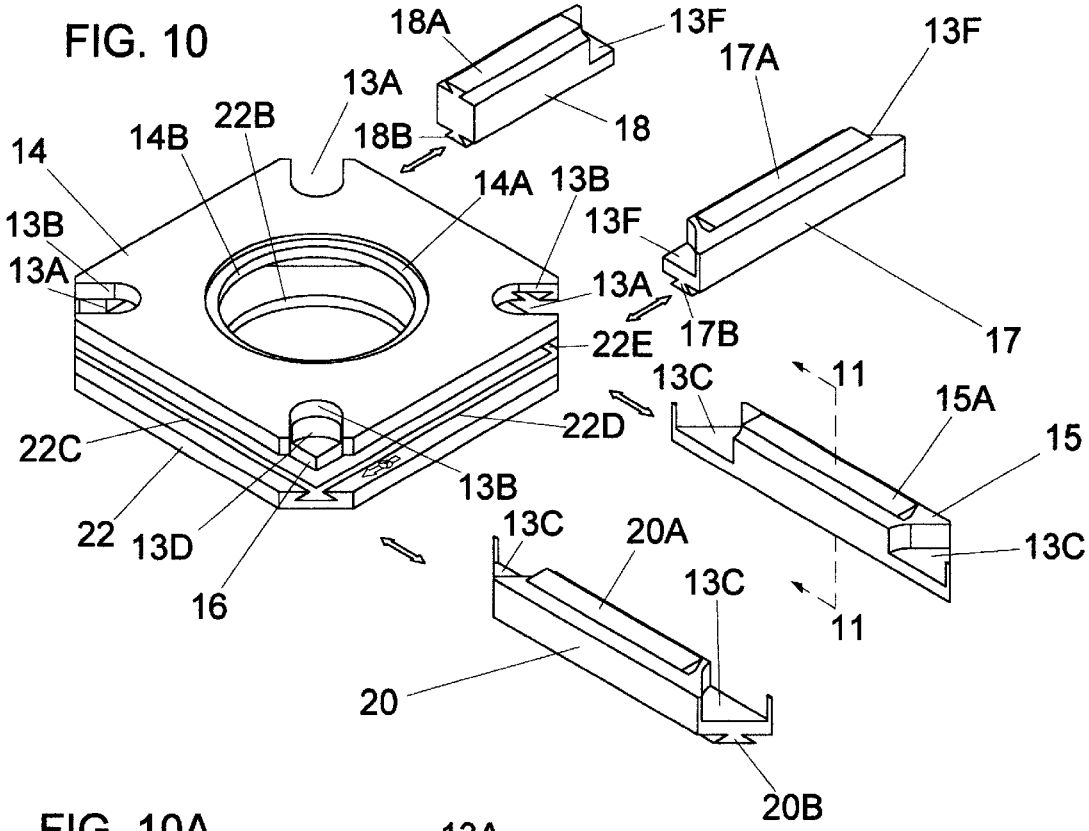
FIGS. 10 and 10A illustrate laminated base details.
Figure 10A:
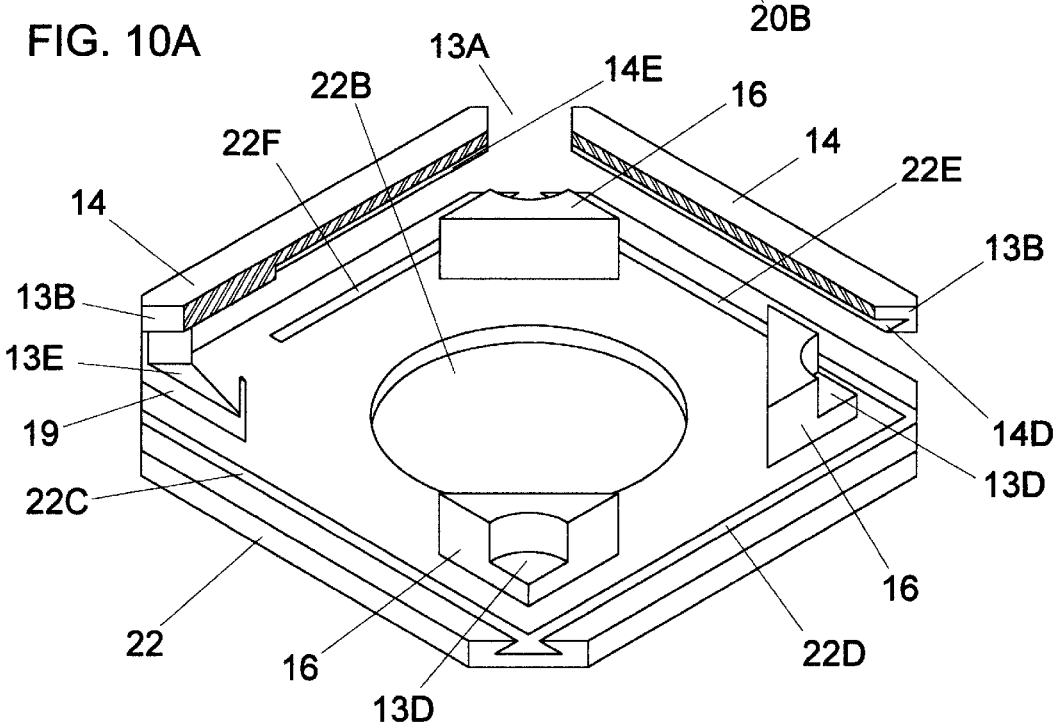
Figure 11:
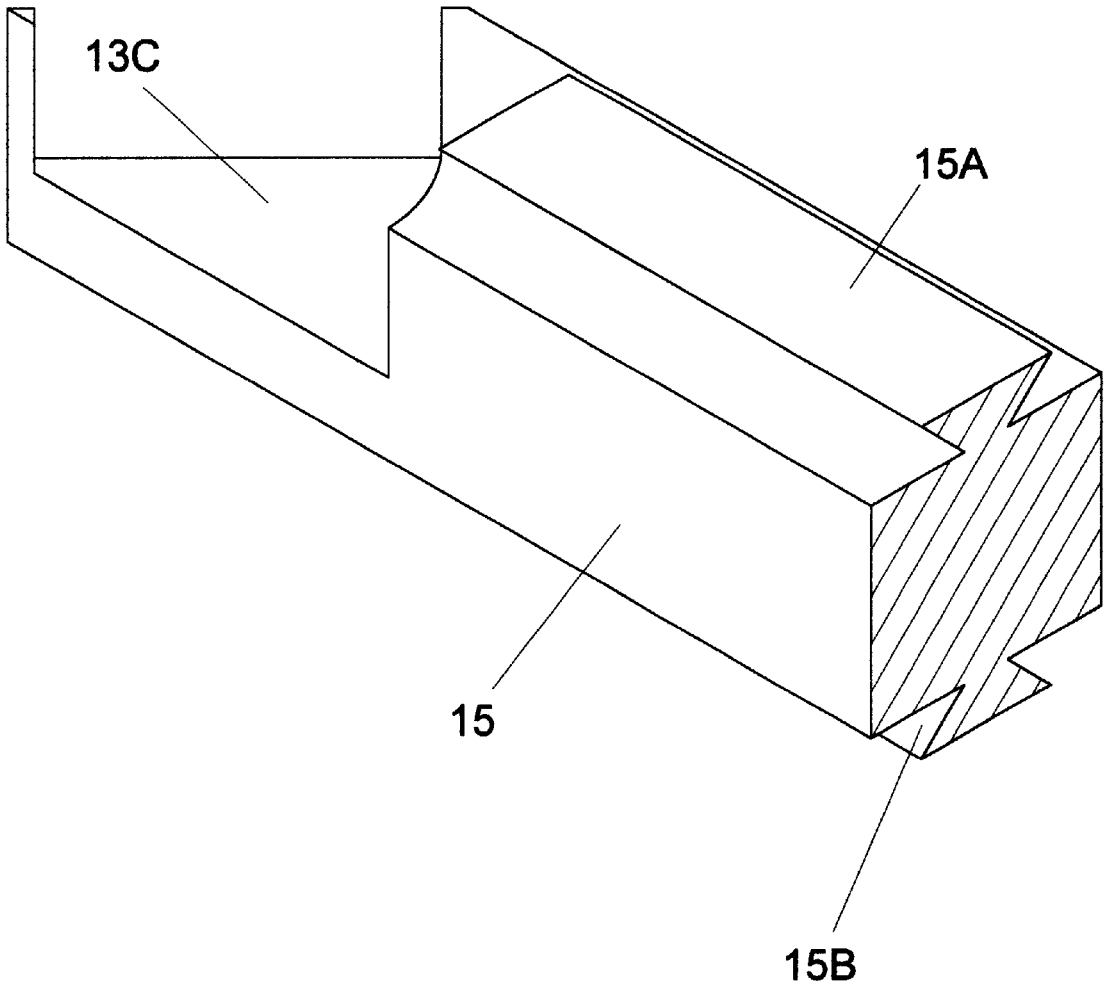
FIG. 11 is a cutaway illustration of a sidewall with dovetail locking inserts.

Note in FIG. 8 that the vane 24 is sloped from the locking ring 23. This creates a dynamic inlet that works in conjunction with a vortex created by the rotation of said shaft 12 and a venturi-siphon effect from said impeller 26 to give a higher volume flow than can be achieved with either a cup type impeller or a vane type impeller without such a slope. The venturi-siphon effect is enhanced by a chamber 26A (Ref. FIGS. 3 and 12) formed by the locking ring 23, the vanes 24, and said plate 25.

As shown in FIGS. 1, 2, and 4, the locating tapers 10A of the supports 10 fit into the tapered sockets 9 of the motor mount 4 and are pinned in place through the locking pin apertures 10A of the supports 10. The locking grooves 10B of the supports 10 permit each of the supports 10 to be inserted into one of the boss clearances 13A of the laminated base 13. Said drift pin clearances 4B and 9B facilitate separation of the posts 10 from the motor mount 4 using a drift pin to encourage separation of each post 10 from the tapered sockets 9 of the motor mount 4. This is an advantage over prior art.

The internally tapered coupling 6 shown in FIG. 1, facilitates shaft removal without removal of the motor 2 and the reduction gear assembly 2A from the motor mount 4.

Although the description above contains many specificities, these should not be construed as limiting the scope of the invention but as merely providing illustrations of some of the presently preferred embodiments of this invention.

For example, said impeller 26 and the laminated base 13 can be assembled with a variety of conventional attachment techniques such as cement, pins, or interlocking joints.

Also, the bearing 8 is shown as below the motor mount 4 in FIG. 1. In the event a prior art direct drive electric motor is used, the bearing 8 can be mounted below or above the motor mount 4.

While carbon graphite was mentioned as material, other materials, such as ceramics or refratories may serve for some of those parts mentioned.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A molten metal pump comprising:

a molten metal inlet and outlet;

drive motor means and motor mount;

an impeller shaft and coupling connecting the impeller shaft to the drive motor means;

a base and supports connecting said motor mount to said base;

an impeller on said impeller shaft;

wherein the motor mount supports the drive motor means and wherein the impeller shaft is supported by a bearing in said base;

tapered sockets on said motor mount;

tapered ends on said supports fitting in said tapered sockets on said motor mount and pin means releasably pinning said supports to said motor mount.

2. The molten metal pump of claim 1 wherein said supports are releasably connected to said base.

3. The molten metal pump of claim 1 wherein said coupling comprises a shaft coupling pin interconnecting the shaft to the drive motor means, such that removal of the shaft coupling pin allows for separation of the drive motor means from the impeller shaft.

4. The molten metal pump of claim 1 wherein the impeller is a fabricated chambered vane impeller.

5. A chambered vane impeller molten metal pump comprising:

molten metal inlet and outlet;

a chambered vane impeller connected to a shaft and said impeller pumping molten metal from said inlet toward said outlet; drive motor means connected to said shaft by a releasable pin coupling;

said shaft connected to each vane of said impeller by a mortise groove in said shaft and a cooperating tenon on said vane;

a base and a bearing in said base rotatably supporting said shaft;

motor mount supporting said drive motor means;

column supports releasably connecting said base to said motor mount.

6. The chambered vane molten metal pump of claim 5 wherein each of said column supports comprises a tapered end and a release pin passing through a portion of said motor mount and a portion of each said tapered end.

7. The molten metal pump of claim 1 wherein the drive motor means comprises a motor and a gear reduction assembly.

8. The molten metal pump of claim 1 wherein the drive motor means is an electric motor.

9. The molten metal pump of claim 1 wherein the drive motor means is an air motor.

10. The molten metal pump of claim 1 wherein the drive motor means is a hydraulic motor.

11. The molten metal pump of claim 5 wherein said impeller comprises:

a locking ring with locking slots;

a bottom plate with mortise grooves;

impeller vanes, each of said vanes further comprising a locking notch;

wherein the locking notch of each of said vanes mate with a locking slot on said locking ring.

12. The molten metal pump of claim 1 wherein the base is a fabricated base.

13. the molten metal pump of claim 12 wherein said base comprises:

a top plate;

side plates;

a bottom plate;

wear rings;

directional guides.

* * * * *